US006348127B1

(12) United States Patent
Gallagher et al.

(10) Patent No.: US 6,348,127 B1
(45) Date of Patent: Feb. 19, 2002

(54) PROCESS FOR PRODUCTION OF CHEMICAL PULP FROM HERBACEOUS PLANTS

(75) Inventors: Hugh P. Gallagher, Goshen; Nelson F. Hill, Monroe, both of NY (US); Curtis P. Koster, Mahwah, NJ (US); Robert F. Cassidy, Warwick, NY (US)

(73) Assignee: International Paper Company, Purchase, NY (US)

( * ) Notice: Subject to any disclaimer, the term of this patent is extended or adjusted under 35 U.S.C. 154(b) by 0 days.

(21) Appl. No.: 09/252,499

(22) Filed: Feb. 18, 1999

Related U.S. Application Data

(60) Provisional application No. 60/075,238, filed on Feb. 19, 1998.

(51) Int. Cl.[7] ..... O21C 1/00; O21C 3/02; O21C 3/20

(52) U.S. Cl. ..... 162/18; 162/72; 162/82; 162/83; 162/90; 162/96; 162/97; 162/98; 162/99; 162/56

(58) Field of Search ..... 162/18, 83, 90, 162/96, 97, 98, 99, 56, 72, 82, 91

(56) References Cited

U.S. PATENT DOCUMENTS

| | | | | |
|---|---|---|---|---|
| 3,160,552 A | | 12/1964 | Russell et al. | |
| 3,579,418 A | * | 5/1971 | Ostberg | 162/18 |
| 3,620,910 A | | 11/1971 | Lawrence | |
| 3,620,911 A | * | 11/1971 | Eklund | 162/96 |
| 3,927,235 A | | 12/1975 | Chow | |
| 4,106,979 A | | 8/1978 | Ruffini et al. | |
| 5,334,445 A | | 8/1994 | Ruyter et al. | |
| 5,343,596 A | | 9/1994 | Kaldor | |
| 5,415,736 A | | 5/1995 | Grether | |
| 5,435,844 A | | 7/1995 | Sasaya | |
| 5,465,464 A | | 11/1995 | Chen et al. | |
| 5,492,756 A | | 2/1996 | Seale et al. | |
| 5,507,074 A | | 4/1996 | Chen | |
| 5,753,075 A | * | 5/1998 | Stromberg et al. | 162/52 |

FOREIGN PATENT DOCUMENTS

| | | |
|---|---|---|
| EP | 0 613 321 A1 | 8/1994 |
| WO | WO89/02951 | 4/1989 |
| WO | WO96/19328 | 6/1996 |
| WO | WO99/41448 | 8/1999 |

* cited by examiner

*Primary Examiner*—Steve Alvo
(74) *Attorney, Agent, or Firm*—Luedeka, Neely, & Graham, P.C.

(57) ABSTRACT

A process for production of chemical fibrous pulp for making paper, paperboard and other fibrous products from herbaceous plants, such as kenaf. Pulp from the herbaceous plant is made by a process which involves densification of pieces of all or part of the plants; i.e., both the core and the stalk or just the core portion, into cubes or pellets having a density ranging from about 15 to about 70 lbs/ft$^3$, preferably from about 25 to about 50 lbs/ft$^3$, which are then chemically digested to produce a fibrous pulp. The densified cubes or pellets may be digested alone or together with conventional wood chips. A principal advantage of the invention is that the densified cubes or pellets exhibit significantly better yield and strength after treatment by conventional chemical pulping methods as compared with the undensified material, enabling more efficient and economical use of this material to supplement limited supplies of conventional hardwood and softwood pulp sources.

33 Claims, 5 Drawing Sheets

PROCESS FOR PRODUCTION OF CHEMICAL PULP FROM HERBACEOUS PLANTS

RELATED APPLICATION DATA

This application claims the benefit under 35 U.S.C. § 119(e)(1) of the filing date of provisional application Serial No. 60/075,238, filed Feb. 19, 1998.

FIELD OF INVENTION

This invention relates to a process for the production of pulp for making paper and other fibrous products from herbaceous plants. Specifically the invention relates to a process for improving the yield, strength and other properties of chemical pulp made from herbaceous plants, especially kenaf.

BACKGROUND

It is well known to use hardwood and softwood as sources of fiber in the manufacture of paper and other fibrous products. However, due to the decreasing supply and attendant increasing cost of conventional wood sources, more attention is being paid to alternative sources of fiber for paper and paperboard production.

Herbaceous plants do not develop persistent woody tissue, but instead die back at the end of each growing season. However, they can be an attractive alternative to conventional wood fiber sources because of their relatively high productivity in terms of tons of fiber per acre per year. Nevertheless, several problems exist with using herbaceous plants in conventional pulp making machines. For example, herbaceous plant tissue is generally much less dense than that of conventional wood sources and logistical problems exist in transporting and storing sufficient amounts of herbaceous plant material for use in producing commercial quantities of useable pulp. In addition the fibers are more delicate and not readily suited for use in conventional wood pulping processes.

The woody tissue of plants, comprised primarily of tracheids of vessels, is called xylem. Herbaceous plants may or may not contain xylem, however those containing xylem are believed to provide the most desirable raw material for modern papermaking pulp.

Dicotyledonous plants such as kenaf, hemp, jute etc., contain xylem and are therefore potentially useful in making pulp for fibrous products. Monocotyledonous plants such as grasses, corn, and bamboo do not contain xylem and are therefore less desirable.

Hemp is an excellent example of a dicotyledonous plant suitable for use in fibrous products pulp. However, hemp is a controlled substance in the United States and presents logistical problems in terms of its supply.

Kenaf is an annual dicotyledonous plant originally grown mainly in India and tropical Africa, but is now cultivated all over the world. It can grow to heights of twelve feet or more in a four to six month growing season, and can yield six to nine tons of whole plant fiber per acre. Kenaf's relatively high agricultural yield and dicotyledonous structure make it an attractive candidate as a wood chip supplement. However, the bulkiness of herbaceous plants, such as kenaf can create transportation and storage problems not associated with conventional wood fiber.

Alternative methods of making chemical pulp from kenaf have been explored, but the requirement of special equipment and processes have limited the use of these methods on a commercial scale. For example, U.S. Pat. No. 3,620,910 to Lawrence describes methods for preparation of groundwood pulp from a fibrous plant such as kenaf by a semi-mechanical pulping process. In the process of the '910 patent, kenaf is first screened to remove foreign materials and dirt, then soaked in water. After draining the excess water from the material, it is chopped and then processed in a screw conveyor to a solids content of fifty to sixty percent. The resulting material is then treated with an aqueous solution containing 10 parts each of sodium sulfite and sodium carbonate at atmospheric pressure and ambient temperature to uniformly wet the pieces. After this treatment, the material is fed to a disc refiner to produce groundwood pulp. This process can be effective on a limited scale, but it does not integrate well with conventional pulp and papermaking facilities used by the vast majority of the industry.

U.S. Pat. No. 4,106,979 to Ruffini et al describes methods for separating the stalk from the woody core of dicotyledonous plants such as kenaf. The process of the '979 patent is carried out by defibrating kenaf in a mechanical pulper with steam treatment until the woody core is separated from the bark fibers. The stock is then divided into a long fiber bark fraction and a woody fraction. The woody fraction is used for refiner groundwood, chemimechanical or semi-chemical pulp production and the long fiber fraction is used as stock for production of bleached pulp. This process adds costly refinement steps and would also not be useful in most conventional chemical kraft pulping processes.

Accordingly, it is an object of the invention is to provide a process for the production of chemical pulp from herbaceous plants such as kenaf.

An additional object of the invention is to provide a process employing material from herbaceous plants for making pulp in a chemical pulp processor.

Still another object of the invention is to provide a process for the treatment of herbaceous plants such as kenaf, which facilitates economical transportation of the material to a pulp mill.

An additional object of the invention is to provide a process which facilitates the use of herbaceous plant material in combination with conventional wood chips in making chemical pulp for production of paper and other fibrous products.

A further object of the invention is to provide a process for treating herbaceous plants such as kenaf to improve their pulpability in a chemical pulping process.

Yet another object of the invention is to provide a process of the character described for the treatment of kenaf and other herbaceous plants in a chemical pulping process wherein the resulting pulp exhibits improved properties, especially in regard to the yield and strength of the pulp.

A still further object of the invention is to provide paper, paperboard and other fibrous products made in whole or in part of fibers from kenaf or other herbaceous plants which exhibit improved properties and/or which may be produced more economically than known products containing such fibers.

SUMMARY OF THE INVENTION

With respect to the above and other objects and advantages, the present invention provides a process for production of chemical pulp from herbaceous plants. In accordance with its more general aspects, the process comprises chopping or otherwise dividing at least a portion of a herbaceous plant into pieces, densifying the herbaceous plant pieces to provide densified agglomerates and chemically pulping the agglomerates to provide a chemical pulp thereof.

Due to its availability and other factors, kenaf is especially preferred for use in practicing the invention. Depending on the end use of the pulp, the entire plant may be used or the plant bark and core material may be separated and only the core material used.

The dividing of the plant into pieces is preferably carried out by chopping the plant (or a portion thereof) using equipment conventionally employed for hay, straw, and similar agricultural materials, and then densifying of the pieces is preferably carried out using a machine suitable for forming and compressing particulate solids into discreet agglomerates such as pellets, cubes, briquettes and the like. For convenience, the densified agglomerates will be referred to hereinafter as cubes, but it will be understood that, unless otherwise stated, that the densified agglomerates may have any shape or dimensions suitable to promote their pulpability in a digester.

The densified cubes are preferably chemically pulped using the well-known kraft cooking process, although other chemical or semi-chemical cooking or digesting processes may be used such as soda or sulfite cooking processes. The densified cubes may thus be cooked in an aqueous liquor containing reagents selected from the group consisting of sodium hydroxide, sodium carbonate, sulfuric acid, sodium sulfite, sodium sulfide, and quinones, said quinones being selected from the group consisting of anthraquinone, anthrone and phenothremiquine and alkyl, alkoxy and amino derivatives thereof. Furthermore, the densified cubes may be used alone or mixed with chemically pulpable material from other sources such as conventional softwood or hardwood chips and/or shredded recycled paper or paperboard material.

The process of the invention enables production of improved quality pulp for paper and paperboard manufacture formed entirely or in part of material from herbaceous plants. In particular, the process enables herbaceous plant material such as kenaf to be subjected to chemical pulping techniques with improved pulp yield and strength and without the need for significant or expensive additional process steps, and the chopping and densification steps may be carried out at or near the harvesting facility so that the bulk of material transported to the pulp mill is minimized. Also, while conventional pulp fiber sources are renewable, the time risk, and expense involved in replanting or reseeding and then maintaining timber stands through a multi-year growing cycle present distinct disadvantages compared with herbaceous plants which can be harvested on an annual or semi-annual basis with relatively low maintenance and processing expense.

As a result of these and other advantages, the invention enables increased and more economical use of readily available pulp fiber sources which are harvestable on a much more frequent basis than conventional pulp fiber sources.

BRIEF DESCRIPTION OF DRAWINGS

The above and other features and advantages of the invention will become apparent from a consideration of the ensuing description of its various known embodiments considered in conjunction with the accompanying drawings, in which.

DESCRIPTION OF PREFERRED EMBODIMENTS

Figure 1:
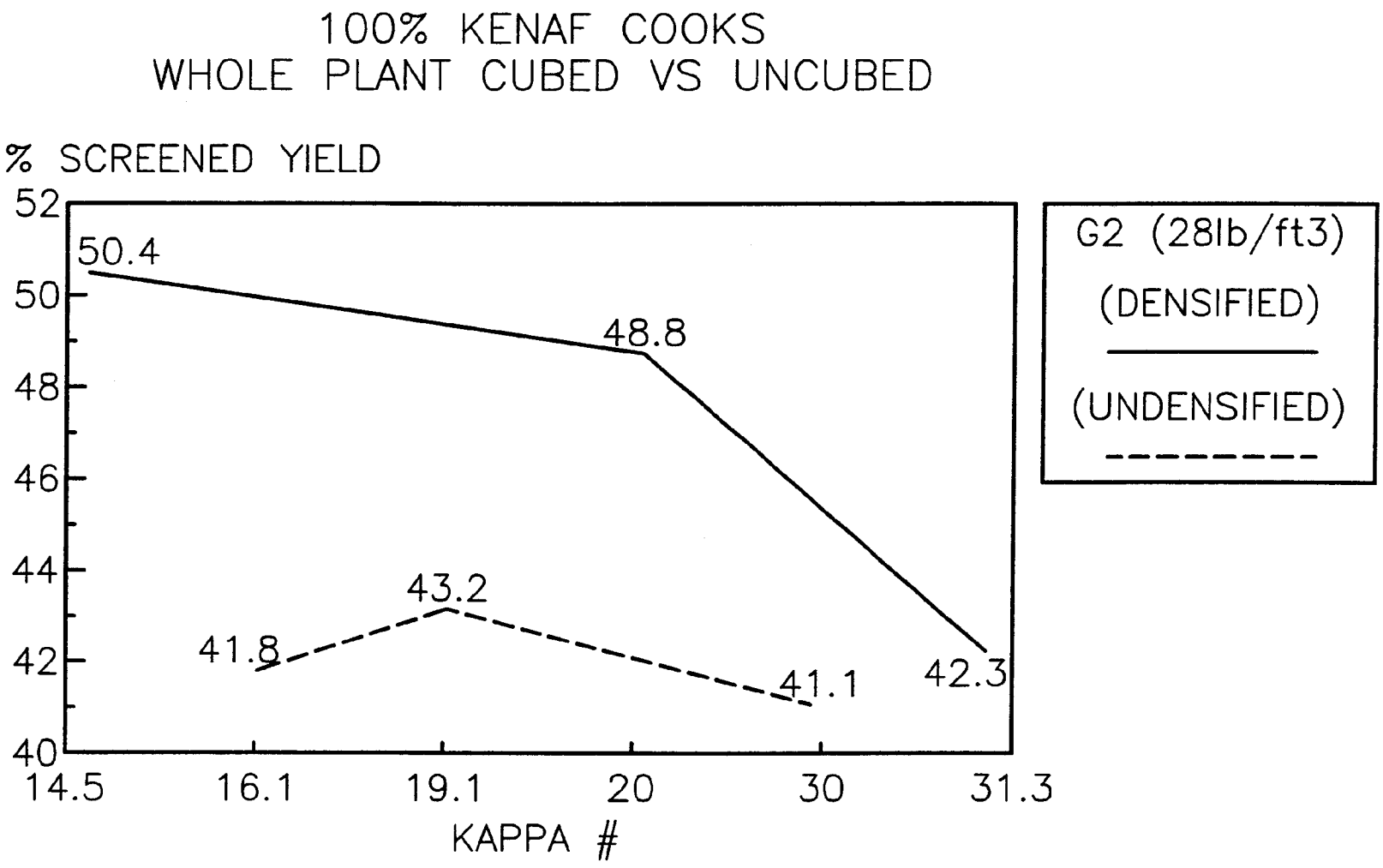
FIG. 1 is a graphical illustration comparing relationships between screened yield and kappa number for kenaf treated according to various embodiments of the invention.

The present invention involves production of cellulosic fiber pulp for manufacture of paper, paperboard and other fibrous products using herbaceous plant material as a source of part or all of the pulp. The invention has a special emphasis on use of kenaf, which will be used herein as the principal illustration of the process technology of the invention, but it will be understood that the invention is believed to be generally applicable to any herbaceous plant as a technique for improving its pulpability by chemical pulping or digestion methods.

In accordance with a preferred embodiment of the invention, the kenaf plant is first chopped or otherwise divided into pieces of suitable size and configuration for subsequent densification to provide discrete, densified cubes or pellets. The densification is preferably carried out using a commercial cuber such as a Model 200 Cuber, manufactured by Warren & Baerg Manufacturing of Dinuba, Calif. Cubers are commonly used to create feed for livestock and for materials such as fuel.

It is preferred that the chopping result in pieces in the neighborhood of 2 to 5 inches in length. Smaller pieces may adversely affect pulp strength, while larger pieces may not feed properly into the cuber.

It is a feature of the invention that densifying kenaf material into cubes of a certain size, shape, and density enables the material to be processed using conventional chemical digesting techniques with limited adverse affects on yield and strength as compared with prior process. Many different chemical pulp processors (a/k/a "digesters") are known to the industry and are suitable for pulping densified herbaceous plant cubes. Continuous or batch digesters may be used and the material may be treated according to any of the known or hereafter known chemical or semi-chemical pulping techniques such as kraft, sulfite, and soda pulping methods well-known to those of ordinary skill.

In one embodiment, the densified herbaceous plant cubes are commixed with conventionally prepared softwood or hardwood chips to create a raw material which is then fed into a chemical pulp digester. The herbaceous plants may be of one species such as kenaf or a combination of several species such as kenaf, hemp, jute, flax, sisal, or abaca, which may, under some circumstances, be preferred due to logistical, economic or other reasons. Kenaf and hemp are especially desirable due to the arrangement and content of fibrous cells within the plants. However federal law presently controls the planting and harvesting of hemp. Therefore, readily available kenaf is generally a preferred herbaceous plant source for use in this invention.

The kenaf can be harvested and prepared for processing using any means suitable for the local conditions. For some intended pulps, such as those involved in making paperboard, it may be desirable to separate the core from the bark or bast before chopping the material and feeding it into the cuber, and to use only the core portion of the plant. For other applications, it may be preferred to use the whole plant because cubing the whole plant has been found to provide increased pulp yield. However, it has also been found that use of predominately core material results in smoother surface characteristics of the final product, therefore chopping and cubing core material only may in some instances be more desirable.

The kenaf should be densified sufficiently to limit premature disintegration of the cubes in the digester. Maintaining the proper density is important in order to control liquor penetration and limit the extent of digestion to maintain good pulp yields. To this end, a minimum density of about 15 lbs/ft$^3$ is believed to be sufficient. Overdensification should also be avoided to enable adequate liquor penetration and limit damage to the fibers. Accordingly, it is preferred that the density of the cubes be controlled to no more than about 70 lb/ft$^3$. Also, it is desirable that the moisture content of the material be maintained in the range from about 5% to about 30% by weight for proper cubing, preferably in the range of from about 10 to about 20% by weight.

Similarly, the die size should be selected to create cubes large enough to emulate wood chips, but small enough for use in conventional chemical pulp digesters. Therefore, it is preferred that the die size be selected to make pellets of no less than about ½ inch in any given dimension of length, width, or height, and no more than about 10 inches in any given direction of length, width, or height. A particularly preferred die size is selected to make pellets with dimensions of 4.5×1.25×1.25 inches in length, width and height, respectively, with a tolerance of 0.25 inches in any given direction.

Conventional additives may be mixed with the herbaceous plant material during or before the densification step to improve pulpability and/or promote the desired densification. Such additives include, but are not limited to, binders, calcium, various latexes, lubricants, surfactants natural and synthetic waxes, enzymes, bioactive solutions and inocula. Typically, any additive or additives are mixed with the plant material in the chopping or particleizing step prior to the densification step.

It has been found that densifying kenaf into pellets or cubes enables an increase of up to at least about 20% the screened yield over the same material in an undensified state. As used herein, "screened yield" means the weight percent of pulp fibers not retained on a standard pulp screen with slots ranging from about 0.006 to about 0.05 inches in width.

While densification of kenaf within the aforementioned range of from about 15 to about 70 lbs/ft$^3$ is believed to provide acceptable screen yields, densification of the material into cubes having a density from about 25 to about 50 lbs/ft$^3$ is especially preferred for obtaining higher screened yields, and a target density of about 28 lbs/ft$^3$ is most preferred for obtaining the highest screened yields.

As mentioned above, the chopped core of kenaf may also be densified separately in a cubing machine, but with differing results. Densified cubes of kenaf core exhibit a decreased yield after chemical pulping as compared to the whole plant kenaf, but has the advantage of providing improved smoothness in board manufacture than that achieved with whole plant fiber. In applications such as the outer plies of multi-ply paperboard, this increased smoothness is desirable.

Kenaf plants material prepared in accordance with the invention may be processed or digested in continuous or batch digesters using conventional chemical pulping techniques as previously discussed. However, it should be noted that even the densified material tends to absorb more cooking liquor than conventional wood chips, and therefore it may be necessary to adjust liquor to wood ratio in the digester to accommodate the increased absorption of cooking liquor by the densified cubes. In this regard, chemical pulping methods carried out on conventional wood chips generally employ a liquor to wood ratio (hereinafter "LAW ratio") in the neighborhood of from about 2:1 to about 4:1, although this L/W ratio may change somewhat depending on the cooking chemicals used and the nature of the wood being digested.

Generally speaking, when the substitution of densified kenaf plant cubes for wood chips is about 20% by weight or less, the conventionally used L/W ratio may be maintained or only slightly in increased. However, if the pulp is to be derived entirely of the densified cubes, it is preferred to increase the L/W ratio to ensure sufficient liquor for maintaining a pulp slurry in the digester upon absorption of the liquor by the material. Experience to date has shown at this requires an increase in the L/W ratio to a ratio in the order of 7:1 when the feed to the digester is substantially all densified kenaf cubes, however, depending on the density of the cubes it may be desirable to use an L/W ratio of up to about 10:1.

After digestion, the pulp may be blown from the digester and then washed on conventional pulp washers employing screens of conventional configuration. As mentioned above, the screened yield of material treated according to the invention is significantly increased over that of the treated material, so that more material is available for making pulp. Also, the strength of the pulp may be increased by the treatment, resulting in a synergistic effect. After screening, the pulp may be further processed by conventional refining, bleaching and other treatments in preparation for incorporation into a furnish for making paper or paperboard products, or for use as a source of fiber to make any fibrous article such as pressed board laminates, molded fibrous articles and the like.

Additional features and aspects of the invention will now be illustrated in the following nonlimiting example, wherein all percentages are weight percent and all temperatures are in degrees Celsius unless otherwise indicated.

EXAMPLE

Three series of kraft cooks were carried out to demonstrate the effect of densification of herbaceous plant material in a chemical pulping process. The cooks were performed in a standard laboratory digester using standard cooking chemicals. The focus was to determine the effect of the densification on screened yield, kappa, and fiber properties.

For each series of cooks, kenaf plants were frost killed and field desiccated while standing. The dried kenaf was silage harvested and chopped to 1.5 to 3 inch long pieces. The cubing process works best if the moisture content of the chopped plants is maintained between 10% and 30%. In these tests, the chopped kenaf had a moisture content of from about 12 to about 15%, so it was not necessary to dry or add moisture to the chopped material.

A Model 200 Warren and Baerg Cuber was configured with six different dies in order to density the kenaf into cubes of different dimensions and densities. These runs were carried out at different speeds and with different kenaf compositions to investigate any resulting density and other property differences. Run 1 was conducted at a throughput of 1 ton per hour, while run 2 was conducted at a throughput of 10 tons per hour. Runs 1 and 2 used as the feed material whole chopped kenaf. Run 3 used as the feed material only the kenaf core. The die configurations and resulting densities are shown below.

TABLE 1

DIES SIZE USED TO DENSIFY CHOPPED KENAF

| DIMENSIONS (inches) (Working length × width × height)* | TAPER | CUBE DENSITIES (lb/ft$^3$) |
|---|---|---|
| A = 5 × 1.25 × 1.25 | none | A1–58, A2–56, A3–69 |
| B = 4.5 × 1.25 × 1.25 | none | B1–55, B2–42, B3–66 |
| C = 3.75 × 1 × 1 | width and height | C2–46, 63–70 |
| D = 6 × 1.25 × 1.25 | height | D1–77, D2–49, D3–66 |
| E = 6 × 1.25 × 1.25 | height | E1–61 |
| F = 6 × 1.25 × 1.25 | none | F1–69, F2–52, F3–65 |
| G = 6 × 2.875 × 1.25 | none | G1–42, G2–28, G3–62 |

*"Working length" refers to the total length of the die which is in active contact with the material.

As can be seen, tapered dies were used in some of the tests to investigate the effect of tapering on cubing ease and resulting pulp properties.

Initially, six cooks were carried out to compare undensified whole plant kenaf with densified whole plant kenaf (G2,28-lb./cubic ft.) at various H factors, the H factor being a unit of measure of heat and time of treatment in the digester. The H factor and percent active alkali (% AA) for the first two cooks (one with densified and one with undensified material) were 1,680 and 16%, respectively. The H factor and % AA for the third and fourth cooks (one with densified and one with undensified material) were 1,025 and 16%, respectively. And, the H factor and % AA for the fifth and sixth cooks (one with densified and one with undensified material) was 650 and 14%, respectively. The sulfidity was 26 to 29% and the peak temperature was 170° C. The resulting kappa numbers and screened yields are shown in FIG. 1, wherein the cooks with the highest H factor are shown on the left-hand side of the curves, the cooks with the lowest H factor are shown on the right-hand side of the curves and the cooks with the medium H factor are shown between the left and right-hand sides.

As shown in FIG. 1, densifying whole kenaf results in an increased yield at low, medium, and high H factor levels. FIG. 1 further indicates that at lower H factors, the difference in yield is less pronounced. This is believed to be due to incomplete cooking. As the H factor increases, the densified kenaf screened yield increases until it is well above undensified whole plant levels with the difference approaching 20% at the higher H factors.

Figure 3:
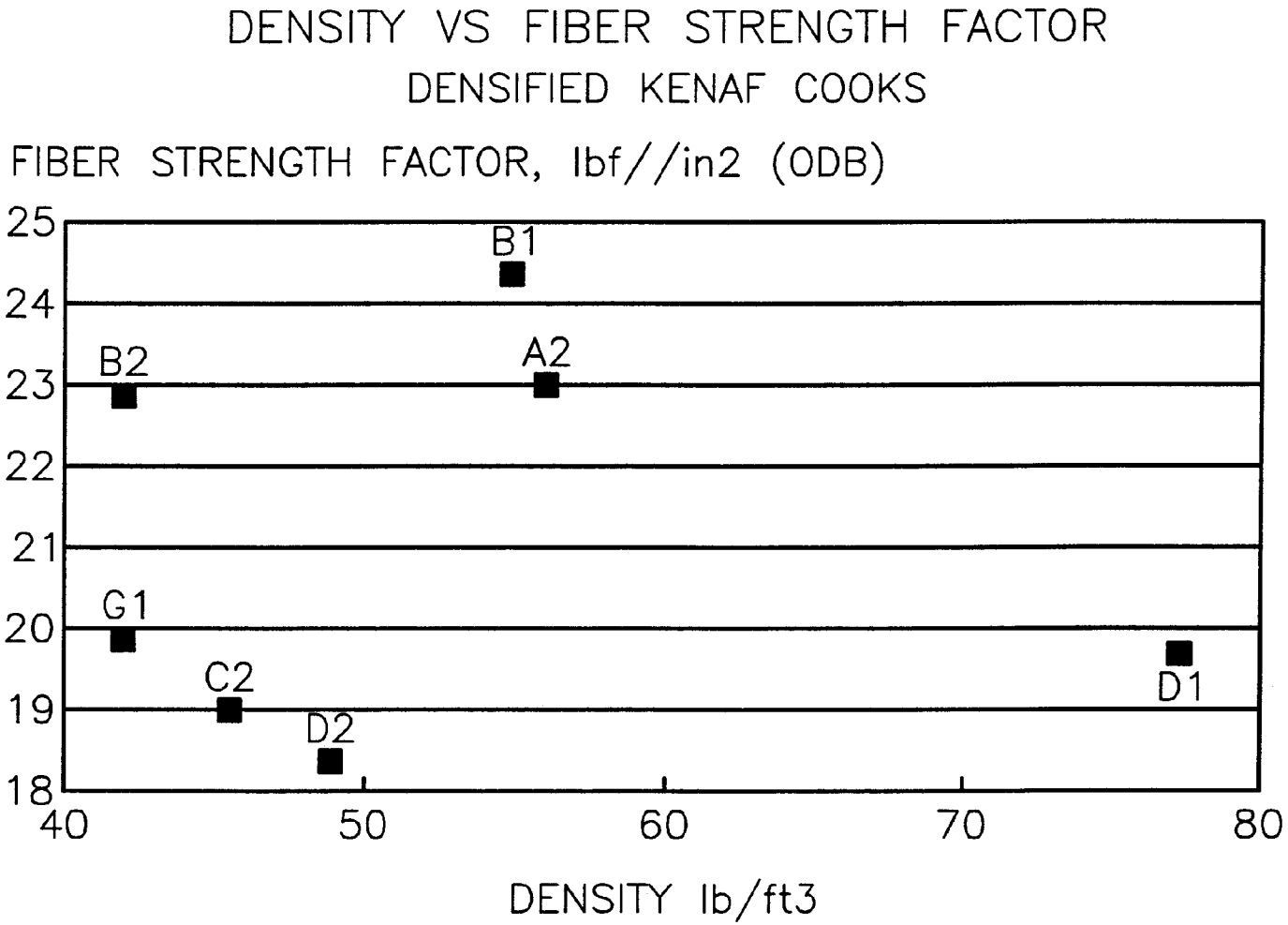
FIG. 3 is a graphical illustration comparing relationships between fiber strength and density for various embodiments of the invention.
Figure 4:
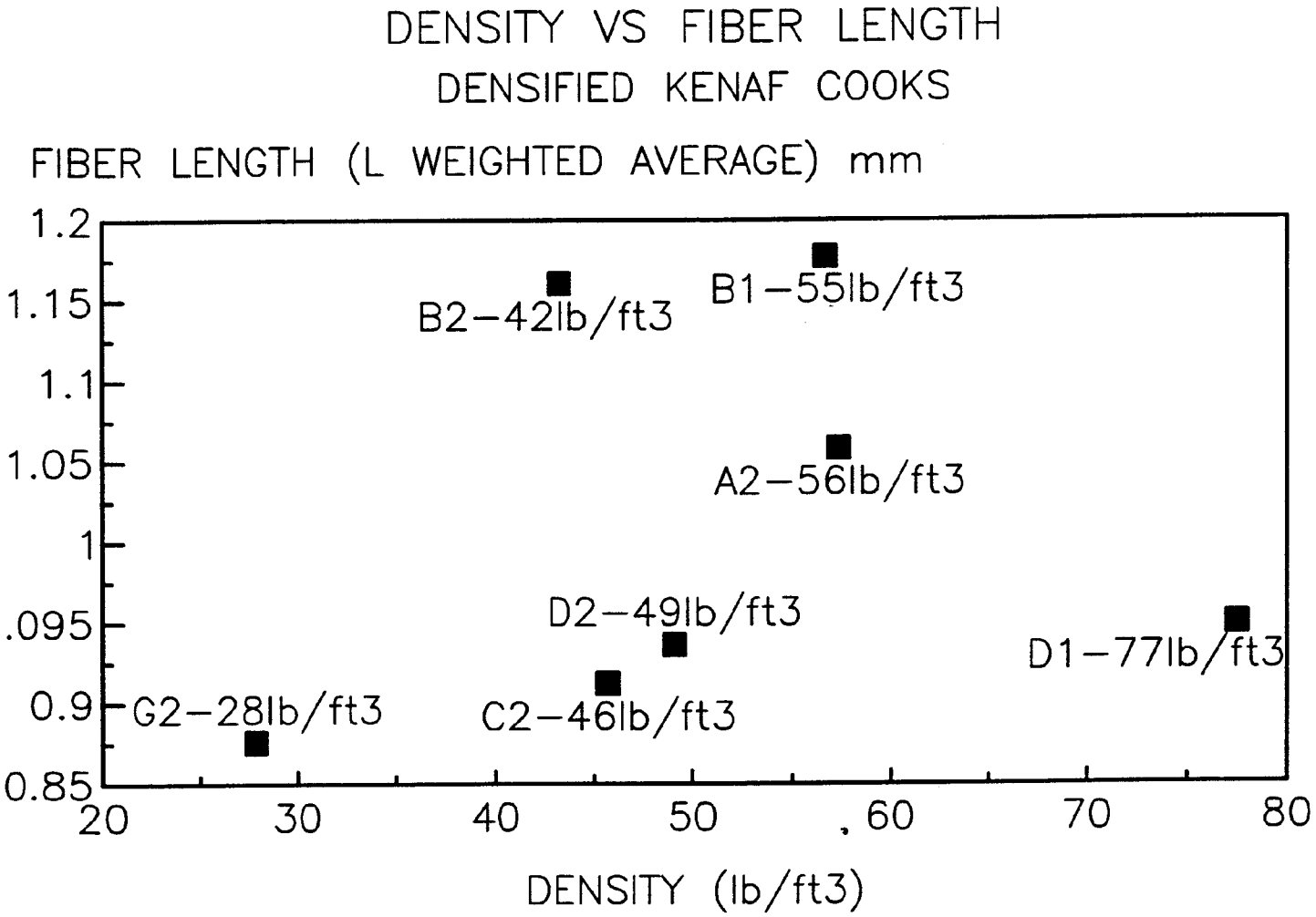
FIG. 4 is a graphical illustration comparing relationships between fiber length and density for various embodiments of the invention.
Figure 5:
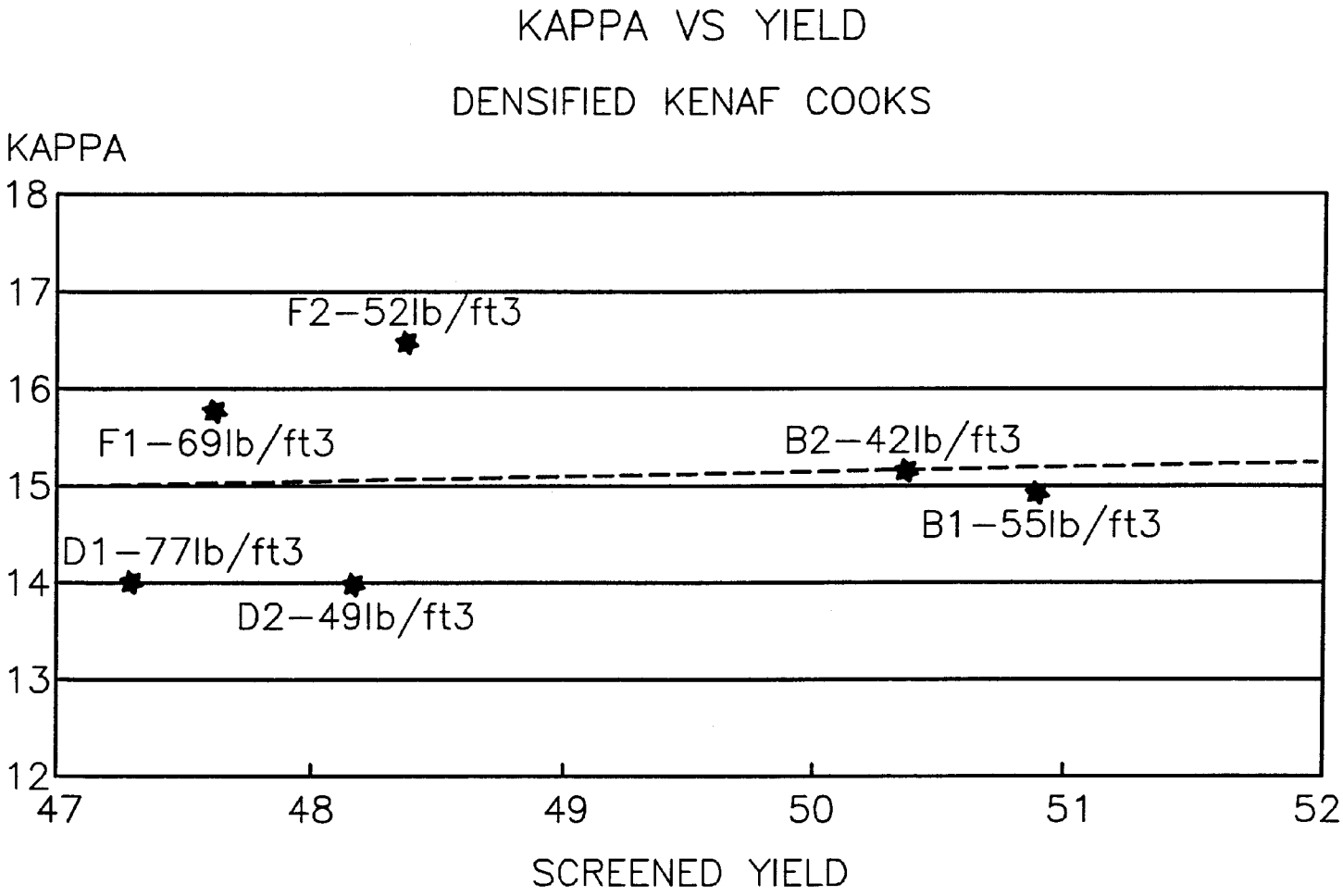
FIG. 5 is a graphical illustration comparing relationships between kappa number and screened yield for various embodiments of the invention.

A second series of cooks was carried out at constant cooking conditions of 14% AA, a peak temperature of 170° C., and an H factor of 1025, to determine the effect of density and cube size on yield at various die settings for cubes from runs 1 and 2. The results are depicted in FIGS. 2 through 5. FIG. 5 shows kappa vs. yield for the second series of cooks. At similar kappas, the cooks for the F, D, and B size pellets show a pattern dictated more by die dimensions than density. Both cooks for the B size pellets showed a higher screened yield than similar cooks for the F and D size pellets. This indicates that a smaller die allows for more complete liquor penetration than larger cubes, but still provides an environment for cooking similar to a conventional pulp. Die size is limited by the densifying apparatus and by liquor penetration. The B size performed most favorably, but the larger sizes also showed improvements over undensified plants.

Fiber length was also affected by the size of the die used for densification. FIG. 4 shows that the B die configuration produced a pulp that had a longer fiber length than the A, C, or D die configurations. As shown in FIG. 3, the B size die showed the greatest fiber strength.

Figure 2:
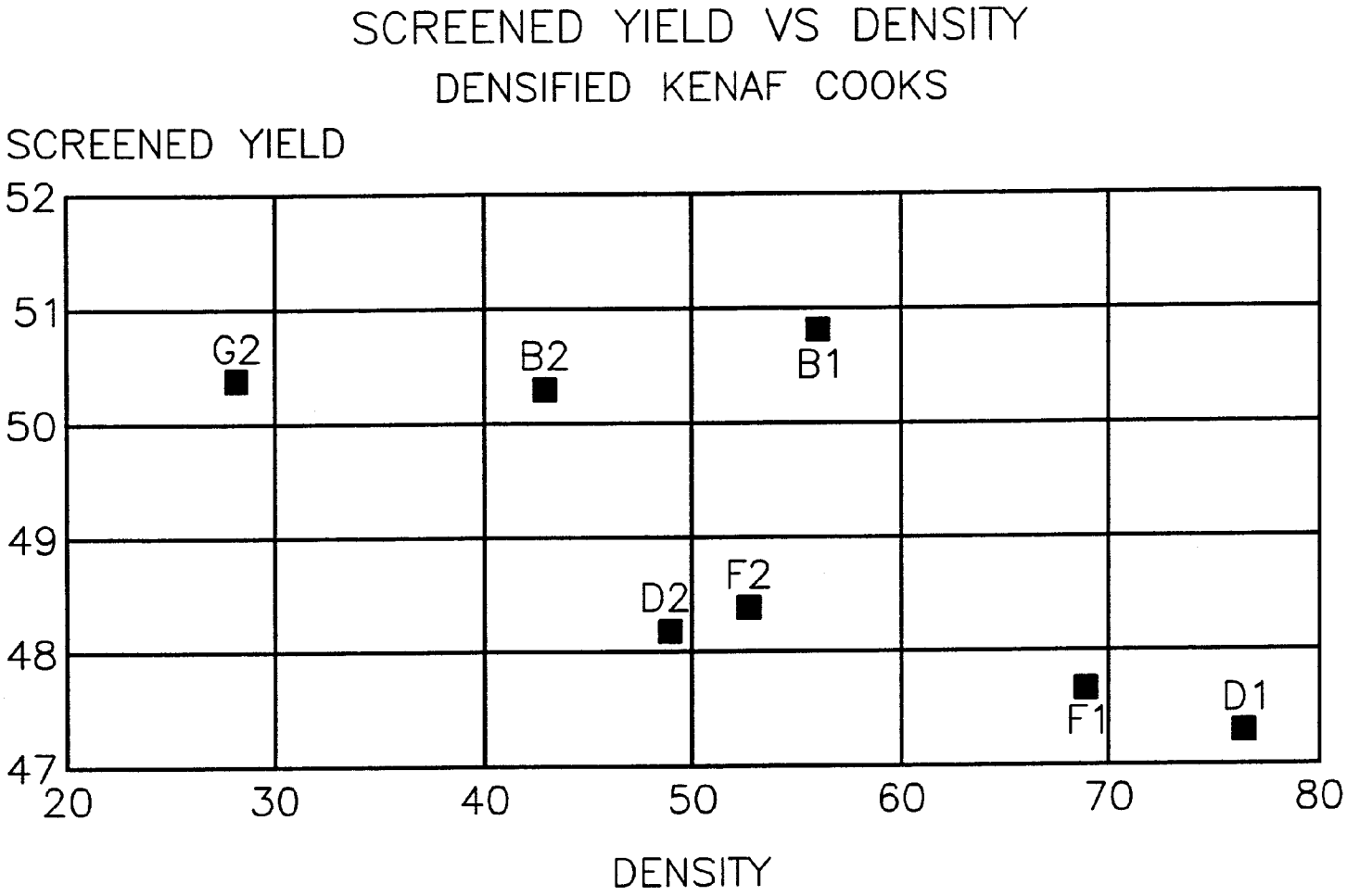
FIG. 2 is graphical illustration comparing relationships between screened yield and density for various embodiments of the invention.

FIG. 2 shows that the B and G die configurations produced screened yields over 50%, while the D and F configurations were generally lower. FIG. 2 also indicates that screened yield is higher at densities below about 60, and that the B die configuration produced densities in the range of 40 to 60.

A third series of cooks were carried out with substitution of whole plant kenaf cubes for hardwood chips in a co-cooking mode. The cubes of densified kenaf were commixed with wood chips as the material was fed to the digester.

In these cooks, the objective was to determine whether substitution of densified kenaf cubes for hardwood chips at a convention L/W ratio of 4/1 would allow production of pulp having a target kappa of from about 15 to 17 and a viscosity (cps) in the 40 to 50 range. The results are shown below in Table 2.

TABLE 2

EFFECT OF SUBSTITUTION OF DENSIFIED KENAF CUBES ON LIQUOR DEMAND AND PULP PROPERTIES

| Fiber | Liq/Wd | Kappa # | Active Alkali | H-Factor | Vissoc.cps |
|---|---|---|---|---|---|
| 100% Hardwood | 4/1 | 15 | 16% | 1,025 | 48.1 |
| 100% Kenaf | 7/1 | 15.2 | 16% | 1,025 | 48.3 |
| 85% Hardwood/ 15% Kenaf | 4/1 | 16.3 | 16% | 1,025 | 41.7 |
| 80% Hardwood 20% Kenaf | 4/1 | 17.1 | 17.8% | 650 | 43.7 |

The data show that substitution of up to about 20 wt. % densified kenaf cubes for hardwood in a co-cooking mode does not materially affect the liquor demand, allowing use of a conventional L/W ratio of 4:1 for achieving target kappa and viscosity values. The data also shows that use of 100% densified kenaf at an L/W ratio of 7:1 enables production of pulp within the target kappa and viscosity values.

It is also noteworthy that the pulp containing 15 wt. % densified kenaf required only 3100 PFI revolutions in subsequent refining to achieve a CSF of 400 whereas the 100% hardwood pulp cooked in the same manner required 3750 PFI revolutions to achieve the same 400 CSF. Accordingly, supplementing densified kenaf cubes is shown to substantially reduce the energy required in the refining step to meet target freeness values.

Accordingly, it can be seen that densification of herbaceous plants such as kenaf improves the pulpability of such material in a chemical pulping process, showing substantially increased yield at low, medium, and high H factor levels. The dimensions and densities of the cubes are important factors in improving the yield and pulp properties from the chemical pulping process. Finally, substitution of up to 20% densified kenaf for conventional wood chips in a co-cooking mode enables production of good quality pulp at conventional L/W ratios, and also reduces the power required to refine the pulp mixture to target CSF values.

The foregoing description of various features and preferred embodiments of the invention including the best mode presently known for practicing the same has been provided for purposes of illustration only, and is not intended to limit the protection afforded the invention according to law, for which resort should be made to the appended claims which establish the scope of the patented invention covering all subject matter literally embraced thereby as well as subject matter equivalent thereto.

What is claimed is:

1. A process for making a fibrous pulp which comprises dividing at least a portion of a herbaceous plant into pieces, densifying the pieces by cubing the pieces to provide densified agglomerates in the form of pellets or cubes having a density of about 15 to about 70 lbs/ft$^3$, and chemically pulping the densified agglomerates to provide a fibrous pulp thereof.

2. The process of claim 1, wherein the dividing step is carried out by chopping at least a portion of the plant into pieces.

3. The process of claim 1 wherein the pieces range in length from about 2 to about 5 inches.

4. The process of claim 1, wherein the pellets or cubes have a density ranging from about 25 to about 50 lbs/ft$^3$.

5. The process of claim 4, wherein the pellets or cubes have dimensions of length, width and height ranging from about ½, ½ and ½ inches to about 5, 5 and 10 inches, respectively.

6. The process of claim 1, wherein the agglomerates are in the form of pellets or cubes having dimensions of length, width and height ranging from about ½, ½ and ½ inches to about 5, 5 and 10 inches, respectively.

7. The process of claim 1, wherein the step of chemically pulping the agglomerates is carried out by treating the agglomerates in an aqueous solution containing reagents selected from the group consisting of sodium hydroxide, sodium carbonate, sulfuric acid, sodium sulfide, sodium sulfite, and quinones, said quinones being selected from the group consisting of anthraquinone, anthrone and phenonthremequine and alkyl, alkoxy, and amino derivatives thereof, at a ratio L:W of weight of cooking liquor (L) to oven-dried weight of cubes or pellets (W) ranging from about 2:1 to about 10:1.

8. The process of claim 1, further comprising mixing the agglomerates with other fibrous material selected from the class consisting of softwood chips, hardwood chips, shredded or otherwise subdivided recycled paper, paperboard or other cellulosic fibrous product material and any mixture of two or more of the foregoing.

9. The process of claim 8, wherein the agglomerates are mixed with the other fibrous material prior to chemically pulping the same and the step of chemically pulping further comprises chemically pulping the other fibrous material along with the cubes or pellets.

10. The process of claim 8 wherein the step of chemically pulping includes a step of feeding the agglomerates into a continuous or batch digester, the step of mixing includes mixing the other fibrous material with the agglomerates as they are being fed into the digester and the step of chemically pulping further comprises chemically pulping the mixture of agglomerates with the other fibrous material.

11. The process of claim 8, wherein the pieces range in length from about 2 to about 5 inches.

12. The process of claim 8 wherein the step of chemically pulping the agglomerates is carried out by treating the agglomerates in an aqueous solution containing reagents selected from the group consisting of sodium hydroxide, sodium carbonate; sulfuric acid, sodium sulfite, sodium sulfide, and quinones, said quinones being selected from the group consisting of anthraquinone, anthrone and phenonthremequine and alkyl, alkoxy, and amino derivatives thereof, at a ratio L:W of weight of cooking liquor (L) to oven-dried weight of cubes or pellets (W) ranging from about 2:1 to about 10:1.

13. The process of claim 1 wherein the herbaceous plant is kenaf.

14. The process of claim 1 further comprising dividing at least a portion of a plurality of herbaceous plants into pieces thereof.

15. The process of claim 14, wherein the plurality of herbaceous plants are all kenaf plants.

16. The process of claims 1 further comprising dividing at least a portion of a plurality of different species of herbaceous plants into pieces thereof.

17. The process of claim 1 wherein the herbaceous plant comprises a plurality of kenaf plants and the step of dividing the plants into pieces comprises chopping the plants into pieces ranging from about 2 to about 5 inches in length.

18. The process of claim 1 further comprising screening the fibrous pulp wherein the screened yield is substantially improved in relation to that of a fibrous pulp produced from the same pulp source or sources without the densification step.

19. The process of claim 1 wherein the process further comprises screening the fibrous pulp wherein the screened yield is at least about 45%.

20. A process for making a fibrous pulp which comprises densifying herbaceous plants into fibrous pellets by cubing the plants to provide densified agglomerates in the form of fibrous pellets having a density of about 15 to about 70lbs/ft$^3$, commixing the fibrous pellets with wood chips to create a fibrous raw material, feeding the fibrous raw material into a chemical pulping digester, and chemically digesting the fibrous raw material in the digester to produce a fibrous pulp thereof.

21. The process according to claim 20 wherein the commixing step is carried out during the feeding step.

22. The process according to claim 20, wherein the herbaceous plants comprise dicotyledonous plants.

23. The process according to claim 20 wherein the herbaceous plants are selected from the group consisting of abaca, flax, hemp, jute, kenaf, and sisal.

24. The process of claim 23 wherein the mixing and feeding steps are carried out substantially simultaneously.

25. The process according to claim 20 wherein the step of chemically digesting the fibrous raw material is selected from the class of chemical digestion steps consisting of kraft, sulfate, sulfite and soda chemical digestion techniques.

26. The process according to claim 20 wherein the weight ratio of wood chips to fibrous pellets ranges from about 60:40 to about 95:5.

27. The process according to claim 20 wherein the fibrous pellets have a width ranging from about 0.5 to about 5 inches, a height ranging from about 0.5 to 5 inches and a length ranging from about 0.5 to about 10 inches.

28. The process according to claim 20 wherein the moisture content of the pieces prior to densification ranges from about 10 to about 30% by weight.

29. The process according to claim 20 further comprising mixing an additive selected from the group consisting of one or more binders, calcium, latexes, lubricants, surfactants, waxes, enzymes, bioactive solutions, and inocula and mixtures thereof with the pieces before densification of the pieces into pellets.

30. A process for making a fibrous pulp which comprises dividing kenaf plants into pieces, densifying the pieces by cubing the pieces to provide fibrous pellets having a density ranging from about 15 to about 70 lbs/ft$^3$, feeding the pellets into a chemical pulping digester, and chemically digesting the fibrous pellets to produce a fibrous pulp.

31. A process for making a fibrous pulp which comprises dividing kenaf plants into pieces ranging from about 2 to about 5 inches in length, densifying the pieces by cubing the pieces to provide fibrous pellets having a density ranging from about 25 to about 50 lbs/ft$^3$, mixing the fibrous pellets with wood chips to create a fibrous raw material, feeding the fibrous raw material into a chemical pulping digester, and chemically digesting the fibrous raw material to produce a fibrous pulp thereof.

32. A process for making fibrous pulp which comprises separating the core material of a plurality of one or more species of herbaceous plants from the stalk material thereof, dividing the core material into pieces ranging in length from about 0.5 to about 5 inches, densifying the core material into pellets by cubing the pieces into pellets having a density of from about 15 to about 70 lbs/ft$^3$, feeding the pellets into a digester, and chemically digesting the pellets in the digester to provide fibrous pulp thereof.

33. A process for making a fibrous pulp which comprises separating the core material of a plurality of one or more species of herbaceous plants from the stalk material thereof, dividing the core material into pieces ranging in length from about 0.5 to about 5 inches, densifying the core material into fibrous pellets by cubing the pieces into pellets having a density of from about 15 to about 70 lbs/ft$^3$, commixing the fibrous pellets with wood chips to create a fibrous raw material, feeding the fibrous raw material into a digester, chemically digesting the fibrous raw material in the digester to produce a fibrous pulp thereof; and washing the fibrous pulp on a screen washer, wherein the screened yield of the pulp from the washer is substantially greater than that of pulp derived from the same source which was not subjected to the densifying step.

* * * * *

UNITED STATES PATENT AND TRADEMARK OFFICE

CERTIFICATE OF CORRECTION

PATENT NO. : 6,348,127 B1 
DATED : February 19, 2002
INVENTOR(S) : Hugh P. Gallagher et al.

It is certified that error appears in the above-identified patent and that said Letters Patent is hereby corrected as shown below:

Column 6,
Line 19, after “slightly” and before “increased”, delete the word -- in --.

Column 10,
Line 5, after “thereof,” and before “at a ratio”, insert -- (hereinafter “cooking liquor”) --.

Signed and Sealed this

Tenth Day of September, 2002

*Attest:*

*Attesting Officer*

JAMES E. ROGAN
*Director of the United States Patent and Trademark Office*